United States Patent [19]

Beck et al.

[11] Patent Number: 4,985,398

[45] Date of Patent: Jan. 15, 1991

[54] THERMAL TRANSFER DYESHEET

[75] Inventors: Nicholas C. Beck, Manningtree; Peter A. Gemmell; Richard A. Hann, both of Ipswich, all of Great Britain

[73] Assignee: Imperial Chemical Industries PLC, London, England

[21] Appl. No.: 433,783

[22] Filed: Nov. 8, 1989

[30] Foreign Application Priority Data

Nov. 11, 1988 [GB] United Kingdom ..... 8826455

[51] Int. Cl.[5] ..... B41M 5/035; B41M 5/26

[52] U.S. Cl. ..... 503/227; 8/471; 428/195; 428/500; 428/913; 428/914

[58] Field of Search ..... 8/471; 428/195, 913, 428/914, 500; 503/227

[56] References Cited

U.S. PATENT DOCUMENTS 4,746,646 5/1988 Nakanishi et al. ..... 503/227

*Primary Examiner*—Bruce H. Hess

*Attorney, Agent, or Firm*—Cushman, Darby & Cushman

[57] ABSTRACT

A dyesheet for thermal transfer printing comprises a substrate supporting a transfer coat comprising a plurality of uniform panels containing different colored thermally transferable dyes, and a further panel in which instead of a colored dye there is a thermally transferable colorless absorber of ultraviolet radiation. Using such a dyesheet, a layer of UV absorber can be applied very simply as an extension of the printing process, by causing the receiver to pass through the printer once more, in contact with the further panel, essentially as though the UV absorber were merely a further color to be added to the print.

7 Claims, No Drawings

THERMAL TRANSFER DYESHEET

The invention relates to the production of coloured images by dye diffusion thermal transfer printing, and in particular to dyesheets for such processes and to their manner of use.

Thermal transfer printing ("TTP") is a generic term for processes in which one or more thermally transferable dyes are caused to transfer from a dyesheet to a receiver in response to thermal stimuli. For many years, sublimation TTP has been used for printing woven and knitted textiles, and various other rough or intersticed materials, by placing over the material to be printed a sheet carrying the desired pattern in the form of sublimable dyes. These were then sublimed onto the surface of the material and into its interstices, by applying heat and gentle pressure over the whole area, typically using a plate heated to 180°–220° C. for a period of 30–120 s, to transfer substantially all of the dye.

A more recent TTP process is one in which prints can be obtained on relatively smooth and coherent receiver surfaces using pixel printing equipment, such as a programmable thermal print head or laser printer, controlled by electronic signals derived from a video, computer, electronic still camera, or similar signal generating apparatus. Instead of having the pattern to be printed already preformed on the dyesheet, a dyesheet is used which comprises a thin substrate supporting a transfer coat comprising a single dye or dye mixture (usually dispersed or dissolved in a binder) forming a continuous and uniform layer over an entire printing area of the dyesheet. Printing is then effected by heating selected discrete areas of the dyesheet while the transfer coat is held against a dye-receptive surface, causing dye to transfer into the corresponding areas of that receptive surface. The shape of the pattern transferred is determined by the number and location of the discrete areas which are subjected to heating, and the depth of shade in any discrete area is determined by the period of time for which it is heated and the temperature reached. The transfer mechanism appears to be one of diffusion into the dye-receptive surface, and such printing process has been referred to as dye-diffusion thermal transfer printing ("DDTTP").

The heat for transferring the dyes can be supplied by printers having thermal printing heads which are pressed against that reverse surface of the dyesheet (or any overlying backcoat). Thermal printing heads have rows of tiny heaters, typically six or more to the millimeter, and these are actuated intermittently according to the electronic signals received by the printer, each to give an individual pixel of the required print (although some modern printers may have more than a single heater per pixel). As mentioned above, the electronic signals used to activate the printer may be from a video, electronic still camera or telefax machine, for example.

Presently available printers can only print one row of pixels at a time, so it is desirable to print them at high speed with short hot pulses, usually from near zero up to about 10 ms, but even up to a maximum of 15 ms in some printers, with each pixel temperature typically rising to about 350° C. during the longest pulses.

Typical receivers used for DDTTP, consist essentially of a sheet-like substrate coated with a dye-receptive layer of a composition having an affinity for the dye molecules and into which they can readily diffuse when the dyesheet is heated during printing.

Dyesheets generally consist essentially of a sheet-like substrate, such as paper or thermoplastic film, supporting on one surface (its obverse surface) at least a transfer coat comprising a thermally transferable dye, usually held in a polymeric binder. Additional coatings may also be present, including for example adhesive and/or dye-barrier subbing layers between substrate and transfer coat, and backcoats on the other (reverse) surface of the substrate for improving slip or heat resistance properties. The dyesheet may be elongated in the form of a ribbon and housed in a cassette for convenience, enabling it to be wound on to expose fresh areas of the transfer coat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels may be provided as longitudinal parallel strips, but are more usually in the form of transverse panels, each the size of the desired print, arranged in a repeated sequence of the colours used. During printing, panels of each colour in turn are then placed on the receiver sheet and passed over the printing head to transfer its dye as required, this to be overprinted by each subsequent colour to make up the full colour image.

To enable prints to be made in this manner, the colours are provided by dyes which can diffuse into the receiver sheet when heated. However, being organic dyes, they are generally susceptible to photofading. We have now discovered how to obtain at least some degree of protection against fading of the print, and have developed a way of applying this protection in a convenient manner.

According to one aspect of the present invention, a dyesheet for thermal transfer printing comprises a substrate supporting a transfer coat comprising a plurality of uniform panels containing different coloured thermally transferable dyes, and further panels in which instead of a coloured dye there is a thermally transferable colourless absorber of ultraviolet radiation (hereinafter referred to simply as "the UV absorber").

We prefer that the thermally transferable dyes and UV absorber be held on the substrate surface by a polymeric binder which remains on the substrate when the dye or UV absorber is thermally transferred. In particular, we prefer that the binder of the further panel be essentially the same as that of each of the other panels, so that printing conditions for the different panels do not then need to be changed to suit changes in binder. However, this further panel may also incorporate additional transferable materials where these are desired to be transferred to the whole area of the print in like manner and under the same conditions.

Subject to its being compatible with a suitable binder for holding it onto the substrate, and with the printed receiver on to which it is to be transferred, the main requirement for the UV absorber is that it shall be thermally transferable under printing conditions which can be applied by the printer used to transfer the coloured dyes to form the print. As the printer has to be programmed to activate all pixel heaters if the whole print is to be covered, the printing times and temperatures may readily be set appropriate to the UV absorber used, up to the printer maximum, as described above. Accordingly, this enables a wide range of compounds to be used, including any whose stability may be endangered by the printer's most extreme conditions. However, we do prefer to use UV absorbers which transfer well and are stable at the maximum pulse conditions of the printer. Examples of commercially available UV absorbers which we have found to transfer effectively using a normal multi-pixel printer (i.e. of the kind that we would use to make the transfer prints themselves), include ADUVEX 24 (Ward Blenkinsop), CYASORB UV-2908 (Cyanamid) and TINUVIN 234 (Ciba-Geigy).

Suitable UV absorber/binder ratios can vary over a wide range for each combination. Thus for example, use too low a ratio and little benefit will be observed, but too much absorber will generally lead to its crystallisation. Film forming properties of the coating rely on the binder selected, and too heavy a loading of the absorber may lead to it flaking off. Thus the level of any such range of useful ratios depends very much on the binder selected. For example, a useful range of absorber/-binder weight ratios for poly(vinyl butyral) binders is generally higher than that for ethyl hydroxyethyl cellulose binders. In general terms, we find the lower useful limit to be between 1:4 and 1:10, and the upper useful limit to be between 1:2 and 2:1, depending on the binder used. Thus most absorbers will give unwanted side effects if used in weights of twice the weight of binder, but at half the weight of the binder, most absorbers will give positive improvement without side effects.

The dyesheet configuration we prefer is one wherein the substrate has an elongated ribbon shape, and the colours are arranged as a repeated sequence along the length of the ribbon, each sequence containing a uniform panel of each colour and a further panel of the UV absorber. The preferred colours are yellow, magenta, cyan and optionally black (and thus are compatible with the present standard electronic colour signals), and with the further panel of UV absorber, these make a sequence of four different uniform panels, or five if black is present, this sequence being repeated along the ribbon.

According to a second aspect of the present invention a method for making a coloured thermal transfer print with protection against ultraviolet radiation-induced fading, by holding a dyecoat of a dyesheet against a dye-receptive surface of a receiver and carrying out a thermal transfer process comprising heating selected areas of the dyesheet to transfer dye to corresponding areas of the dye-receptive surface; and for multicolour prints repeating the transfer process onto the same dye-receptive surface with dyecoats containing different coloured thermal transfer dyes; is characterised by carrying out a further thermal transfer process onto the same dye receptive surface using a dyecoat in which the thermally transferable material is a colourless absorber of ultraviolet radiation.

This method enables a thermal transfer print to be protected against ultra violet radiation without requiring the use of a specially pretreated receiver, the protection being obtained at the time the print is being produced by the selective transfer of the dyes.

We prefer that the step of thermally transferring the UV absorber is carried out after all the steps of thermally transferring the dyes have been completed. We have found that this also gives a surprising additional advantage. Following printing, a thermal transfer print has a very high concentration of transferred dye on or just within the surface of the receiver sheet. This high dye concentration provides a driving force for crystallisation, either induced by heat or the presence of grease on the receiver surface. Also, a greasy finger wiped across the print surface can cause smearing of the dye. We have now found that in prints treated according to the present process after printing with the dyes, the dyes have less tendency to crystallise, and are less prone to becoming smeared when handled. However, at least some protection (and we have not found this to be less) can also be obtained by transferring the UV absorber before transferring the dyes.

We prefer that the UV absorber be transferred to the dye-receptive surface over the whole area of the print or area to be printed respectively, including any areas which have not received or are intended to receive any coloured dye.

EXAMPLE 1

A coating formulation was prepared from the following ingredients:

ADUVEX-24: 1.25 g,
ethyl cellulose: 3.75 g,
toluene: 22.5 g,
methyl ethyl ketone: 22.5 g.

The ADUVEX-24 is a UV absorber sold by Ward Blenkinsop. The trade literature describes it as 2-hydroxy, 4-methoxybenzophenone.

The above formulation was coated onto a subcoated surface of biaxially orientated polyester film substrate, using a Meier bar, to give a wet coat thickness of 36 μm. This resulted in a dry coat thickness of 3 μm. The reverse surface of the substrate film also had a previously applied protective back-coat.

The UV absorber sheet thus prepared was placed against a thermal transfer receiver sheet, the substrate of which contained a UV-activated fluorescent optical brightener, and then passed through a printer programmed to actuate the heaters for all pixels. The resultant print did not appear discoloured or show any other obvious evidence of having been printed with the UV absorber, when viewed in daylight. Subsequent illumination with a UV light source, however, did reveal that the absorber had indeed been transferred, as the fluorescence of the optical brightener was clearly seen to be masked when compared with a piece of receiver sheet that had not been through the printer.

Duplicate prints were prepared in the normal way, using the same standard three-colour thermal transfer dyesheet and under the same conditions, to provide two prints as nearly identical as possible. A piece of the UV absorber dyesheet, prepared as above, was then placed on one of the two prints, and passed through the printer. When compared in daylight, there was little observable difference between these two prints. Under UV light the untreated print seemed a little brighter, but otherwise there was little to show that there was any difference. The two prints were then tested in a Xenotest 150 fadeometer to determine the longer term effect, and the first detectable fading occurred in the untreated print.

EXAMPLES 2-16

A further series of UV-absorbant panels was prepared using the three absorbers referred to above, in the following binders: ethyl hydroxyethyl cellulose (EHEC), poly(vinyl butyral)/ethyl cellulose (PVB/EC, in approximately 4/1 ratio by weight), and poly(vinyl butyral) on its own (PVB), the ratio of absorber/binder being given in the table below. The resulting transfer sheets were examined for evenness of the absorber-containing coating, for crystallisation of the absorber, and for their general condition.

The dyesheets were then placed on receiver sheets carrying thermally transferred prints, and passed through a printer programmed to apply maximum pulses to all pixel heaters. The prints thus treated were compared with untreated prints under UV light, to determine whether the absorber had been transferred by this additional printing step. The results of these evaluations are recorded in the Table 1, below.

A series of sample prints protected after printing by each of these UV absorbers, was examined for stability in an Atlas HPUV light fastness apparatus, and compared with a control which had received no UV absorber but which had been similarly treated in the printer using a plain sheet of dyesheet substrate. The test conditions were as follows:

indoor light: 6.6 $W/m^2$,

UV light: 1.4 $W/m^2$,

UV lamp cycle time off: 46 min/106 min, total exposure time: 50 hours.

The results of the light fastness tests are given in Table 2, where the Example Nos. (Ex.) are the same as those in Table 1. It will be seen that the greatest colour change, as given by Delta E*, occured in the control sample, Example 17, and hence that some protection is obtained with all the UV absorber-containing transfer coats. The results also show that when using transfer coats wherein the UV absorber is held in a PVB-based binder, particularly effective protection can be achieved.

TABLE 1

| EX. | UV ABSORBER | BINDER | ABSORBER :BINDER | TRANSFER COAT CONDITION | EVIDENCE OF TRANSFER |
|---|---|---|---|---|---|
| 2 | ADUVEX 24 | EHEC | 1:3 | Good | yes |
| 3 | " | " | 1:2 | " | yes |
| 4 | " | " | 1:4 | " | yes |
| 5 | " | " | 1:10 | " | no |
| 6 | " | PVB/EC | 1:3 | " | yes |
| 7 | " | " | 1:2 | " | |
| 8 | " | PVB | 2:1 | Poor | |
| 9 | CYASORB V-2908 | EHEC | 1:3 | Crystals | |
| 10 | CYASORB V-2908 | " | 1:2 | " | |
| 11 | CYASORB V-2908 | PVB/EC | 1:3 | Good | Yes |
| 12 | CYASORB V-2908 | " | 1:2 | Crystals | |
| 13 | TINUVIN 234 | EHEC | 1:3 | Good | Yes |
| 14 | TINUVIN 234 | " | 1:2 | " | |
| 15 | TINUVIN 234 | PVB/EC | 1:3 | " | Yes |
| 16 | TINUVIN 234 | " | 1:2 | " | |

TABLE 2

| EX. | UV ABSORBER | BINDER | ABSORBER :BINDER | DELTA E* |
|---|---|---|---|---|
| 17 | CONTROL | NONE | | 6.4 |
| 3 | ADUVEX 24 | EHEC | 1:2 | 3.4 |
| 7 | ADUVEX 24 | PVB/EC | 1:2 | 1.95 |
| 10 | CYASORB V-2908 | EHEC | 1:2 | 6.1 |
| 12 | CYASORB V-2908 | PVB/EC | 1:2 | 4.9 |
| 14 | TINUVIN 234 | EHEC | 1:2 | 5.8 |
| 16 | TINUVIN 234 | PVB/EC | 1:2 | 2.7 |

We claim:

1. A dyesheet for thermal transfer printing comprises a substrate supporting a transfer coat comprising a plurality of uniform panels containing different coloured dye-diffusion thermal transfer printing dyes, and further panels in which instead of a coloured dye there is a thermally transferable colourless absorber of ultraviolet radiation.

2. A dyesheet as claimed in claim 1, wherein the dyes and colourless UV absorber are held on the substrate surface by a polymeric binder which substantially remains on the surface of the of the substrate when the dye or UV absorber is thermally transferred, and wherein the binder of the further panel is essentially the same as that of each of the other panels.

3. A dyesheet as claimed in claim 2, wherein the transfer coat binder comprises poly(vinyl butyral).

4. A dyesheet as claimed in any one of the preceding claims, wherein the configuration of the dyesheet is one wherein the substrate has an elongated ribbon shape, and the colours are arranged as a repeated sequence along the length of the ribbon, each sequence containing a uniform panel of each colour and a further panel of the UV absorber.

5. A method for making a coloured thermal transfer print with protection against ultraviolet radiation-induced fading, by holding a transfer coat of a dyesheet against a dye-receptive surface of a receiver and carrying out a thermal transfer process comprising heating selected areas of the dyesheet to transfer dye to corresponding areas of the dye-receptive surface; and for multicolour prints repeating the transfer process onto the same dye-receptive surface with transfer coats containing different coloured thermal transfer dyes; is characterised by carrying out a further thermal transfer process onto the same dye receptive surface using a transfer coat in which the thermally transferable material is a colourless absorber of ultraviolet radiation.

6. A method as claimed in claim 5, characterised in that the step of thermally transferring the UV absorber is carried out after all the steps of thermally transferring the dyes have been completed.

7. A method as claimed in claim 5 or claim 6, characterised in that the UV absorber is transferred to the dye-receptive surface over the whole area of the print or area to be printed respectively, including any areas which have not received or are intended to receive any coloured dye.

* * * * *